United States Patent [19]

Nouthuka

[11] 4,125,099

[45] Nov. 14, 1978

[54] CARBURETOR WITH FUEL COMPENSATION DEVICE

[75] Inventor: Hirofumi Nouthuka, Katsuta, Japan

[73] Assignee: Hitachi, Ltd., Japan

[21] Appl. No.: 813,239

[22] Filed: Jul. 6, 1977

[30] Foreign Application Priority Data

Jul. 7, 1976 [JP] Japan ..... 51/79917

[51] Int. Cl.[2] ..... F02M 25/06

[52] U.S. Cl. ..... 123/119 A

[58] Field of Search ..... 123/119 A

[56] References Cited

U.S. PATENT DOCUMENTS

| | | | |
|---|---|---|---|
| 3,444,846 | 5/1969 | Sarto et al. | 123/119 A |
| 3,768,452 | 10/1973 | Lewis | 123/119 A |
| 3,800,766 | 4/1974 | Schubeck | 123/119 A |
| 3,903,859 | 9/1975 | Aquino | 123/119 A |
| 3,906,909 | 9/1975 | Garcea | 123/119 A |
| 4,051,824 | 10/1977 | Sugiura | 123/119 A |

*Primary Examiner*—Wendell E. Burns
*Attorney, Agent, or Firm*—Craig & Antonelli

[57] ABSTRACT

A carburetor with a fuel compensation device have an exhaust gas recirculation passage with an exhaust gas recirculation valve, as that an exhaust gas from an engine may flow into a suction passage through the exhaust recirculation passage. The exhaust gas recirculation valve comprises a diaphragm, and controls the exhaust gas flow recirculating in response to vacuum during the recirculation of the exhaust gas. The vacuum is taken in from a vacuum intake port defined in the suction passage, the position of which is disposed slightly upstream of the position of a throttle valve at which idling of the engine is effected. At the same position as that of the vacuum intake port with respect to the fluid flow direction in the suction passage, there defined is an auxiary fuel jet port communicating with a float chamber, so that fuel is jetted into the suction passage corresponding to the quantity of the exhaust gas recirculating.

7 Claims, 5 Drawing Figures

CARBURETOR WITH FUEL COMPENSATION DEVICE

BACKGROUND OF THE INVENTION

This invention relates to an improvement of a carburetor with an exhaust gas recirculation system for internal combustion engines.

For reduction of noxious substances in an exhaust gas and consumption of fuel, it is necessary to make a fuel-air mixture produced by a carburetor lean to the extent within which operation performance of the engine is not lost, which follows protection of a catalyst used for the reduction of the noxious substances, because by the lean fuel-air mixture it is possible to avoid abnormal elevation of temperature adjacent to or at the catalyst. In an internal combustion engine employing the exhaust gas recirculation system for reduction of nitrogen oxides ($NO_x$), it is impossible to make the fuel-air mixture lean over all the scope of operation of the engine, because during the recirculation of an exhaust gas from the engine, the fuel-air mixture is further made lean, so that the operation performance of the engine comes to be extremely bad.

As measures for preventing the fuel-air mixture from being made lean, a vacuum-responsive fuel compensation device supplying fuel into a main fuel passage during running of the engine under a low output is known. The device is provided with a solenoid valve which is driven by a gear switch and suction vacuum detecting switch, and close or open an vacuum passage, so that fuel jetted from the main fuel passage is compensated to produce rich fuel-air mixture. The device, however, closes or opens a fuel compensation valve by making use of a vacuum change and compensates fuel through the main furl passage the nozzle portion of which is provided in a Venturi portion, so that the quantity of compensated fuel is approximately constant and even if the device is used for the exhaust gas recirculation system, it is difficult to effect the compensation of fuel corresponding to a rate of the recirculation of the exhaust gas. Therefore, the reduction of the fuel consumption and the noxious substances in the exhaust gas is not necessarily sufficient.

SUMMARY OF THE INVENTION

An object of the present invention is to provide a carburetor with a fuel compensation device, in which fuel is compensated in accordance with a rate of exhaust gas recirculation only during the exhaust gas recirculation.

Another object of the present invention is to provide a carburetor with a fuel compensation device, in which fuel is compensated in accordance with the rate of the exhaust gas recirculation during the exhaust gas recirculation, and fuel-air mixture sucked into an engine is made lean during operation of the engine except for the exhaust gas recirculation, so that an improvement of fuel consumption and catalyst protection are carried out.

Briefly stated, a feature of the present invention is that an EGR valve for controlling an quantity of exhaust gas recirculating is controlled in response to a vacuum taken in from a port of a suction passage made upstream of a position of a throttle valve at which idling of an engine is kept, and fuel for compensation is sucked into the suction passage from the same position as the port of the suction passage with respect to a liquid flow flowing in the suction passage.

DESCRIPTION OF THE PREFERRED EMBODIMENTS

An embodiment of the present invention will be described hereinafter in detail, referring to FIGS. 1 and 2.

Figure 1:
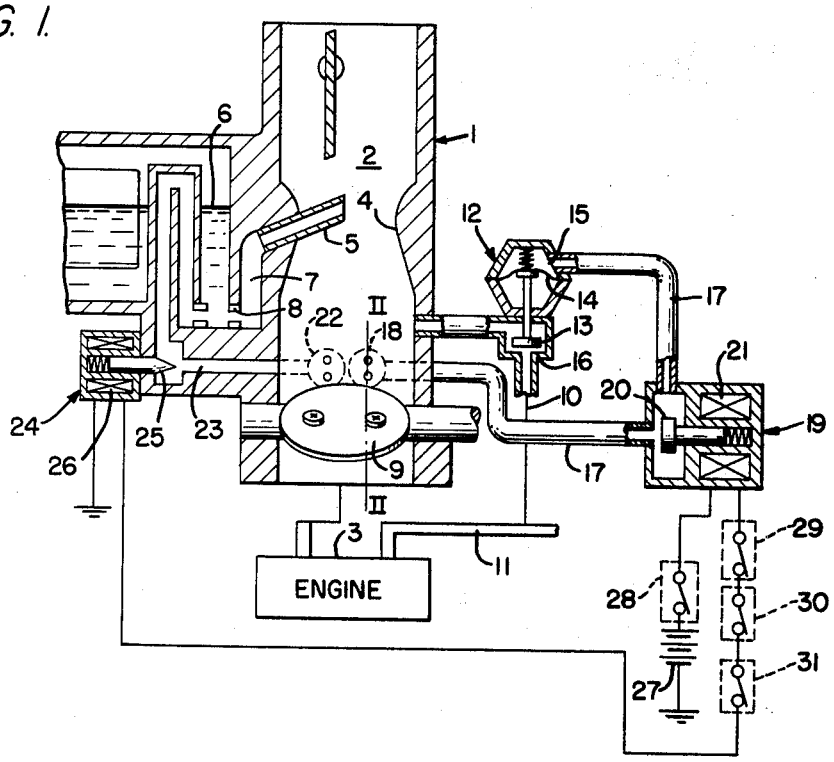
FIG. 1 is a section view of an embodiment of a carburetor with a fuel compensation device according to the present invention.
Figure 2:
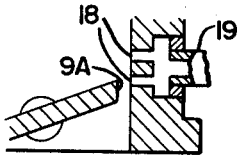
FIG. 2 is an enlarged section view taken along a line II—II of FIG. 1.

In FIG. 1, a carburetor 1 is provided with a suction passage 2 fluidly communicating with an internal combustion engine 3 for automobiles. In the suction passage 2, a Venturi portion 4 is defined, and the carburetor 1 is provided with a main nozzle 5 projecting from the Venturi portion 4 into suction passage 2. The main nozzle 5 communicates with a float chamber 6 through a passage 7 with a main fuel jet 8. The carburetor 1 is further provided with a throttle valve 9 downstream of the Venturi portion 4 with respect to a fluid flow into the engine 3. An EGR (exhaust gas recirculation) passage 10 is connected to the carburetor 1 at one end thereof, and to an exhaust pipe 11 of the engine 3 at the other end so that recirculation of an exhaust gas from the engine 3 is effected. The EGR passage 10 is provided with an EGR valve 12 which is responsive to a vacuum and controls an exhaust gas flow in the EGR passage 10. The EGR valve 12 comprises a valve body 13 for controlling an opening through which the exhaust gas flows, a diaphragm 14 to which the valve body 13 is secured and defines a vacuum chamber 15, and a spring urging the valve body 13 to contact with a valve sheet 16. The vacuum chamber 15 communicates with the suction passage 2 through a vacuum passage 17. As shown in FIG. 2, the vacuum passage 17 is connected to the carburetor 1 at intake holes 18 which are formed at such a portion of the suction passage 2 that is positioned slightly upstream of the side face 9A of the throttle valve 9 at the position that idling of the engine 3 is kept. The vacuum passage 17 is provided with a solenoid valve 19 which has a valve body 20 and a solenoid 21 and controls opening and closing of the vacuum passage 17.

At the approximately same position of the suction passage 2 as the vacuum intake ports 18 with respect to the liquid flow direction in the suction passage 2, an auxiliary fuel jet port 22 is provided. The auxiliary fuel jet ports 22 communicate with the float chamber 6 through an auxiliary fuel passage 23 with a solenoid valve 24 which has a valve body 25 for controlling fuel flowing in the auxiliary fuel passage 23 and a solenoid 26 for electrically operating the valve body 25. The solenoid valve 24 is electrically connected to an electric circuit comprising an electric source 27, a key switch 28 for operating the engine 3, the solenoid 21 of the solenoid valve 19, a speed change gear switch 30, a water-temperature sensitive switch 30, and a suction vacuum switch 31. For example, the speed change gear switch is made on except for such a time as a speed change gear is meshed in highest gear (in top), the water temperature sensitive switch 30 is made "on" for example at a temperature between 50° C. and 60° C., and the suction vacuum switch 31 is made "on" when the vacuum detected slightly upstream of the throttle valve is −80 mmHg. That is, by the electric circuit the scope of the operation of the engine in which the exhaust gas recirculation is needed, is determined.

When all of these switches 28, 29, 30 and 31 are made "on", the solenoids 21 and 26 are energized to urge the valve bodies 20 and 25 to move so that the EGR passage 17 and the auxiliary fuel passage 23 are opened. The EGR valve is opened in response to the magnitude of the vacuum applied to the diaphragm 14, that is the magnitude of the vacuum applied to the ports 18. The opening of the EGR valve 12 is proportional to the magnitude of the vacuum at the ports 18 in the suction passage 2. On the other hand, when one of these switches 28, 29, 30 and 31 is made "off", both the solenoid valves 19 and 24 are closed.

Next, an operation of the abovementioned embodiment will be explained hereinafter.

When the internal combustion engine 3 is idling, the throttle valve 9 is opened to the extent of that the engine 3 can keep it idling. In such a opening of the throttle valve 9, the vacuum intake ports 18 and the auxiliary fuel jet ports 22 are positioned slightly upstream of the throttle valve 9 with respect to the fluid flow direction in the suction passage 2 as shown in FIG. 2, so that the vacuum applied to the ports 18, 22 is very small. Therefore, even if all of the switches 28, 29, 30 and 31 is made "on" and the solenoid valves 19 and 24 are opened, the exhaust gas recirculation is not effected and fuel from the auxiliary fuel jet ports 22 is not sucked into the suction passage 2. In order to increase engine speed, the throttle valve 9 is further opened, whereby the vacuum intake ports 18 and the auxiliary fuel jet ports 22 come to be positioned downstream of the throttle valve 9 (the sideface 9A thereof) and vacuum applied to those ports 18 and 22 comes to be larger. Accordingly, if all of the switches 28, 29, 30 and 31 are made "on" to open the solenoid valves 21 and 24, the larger vacuum from the ports 18 is applied to the vacuum chamber 15 of the EGR valve 12 through the vacuum passage 17 and the solenoid valve 19, the valve body 13 is moved against the spring to open the valve 12 so that exhaust gas from the engine is recirculated through the exhaust pipe 11, the EGR passage 10, the EGR valve 12 and the suction passage 1 and at the same time fuel in the float chamber 6 is sucked into the suction passage 2, according to the vacuum at the auxiliary fuel ports 22, that is a quantity of fuel corresponding to a rate of the recirculation of the exhaust gas is jetted from the auxiliary fuel jet ports 22, so that desired fuel-air ratio is obtained.

Figure 3:
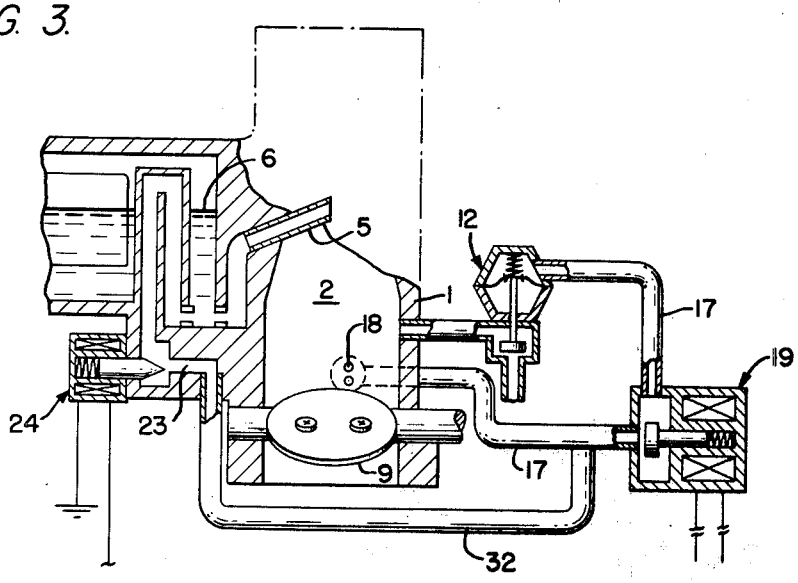
FIG. 3 is a section view of a modification of the embodiment shown in FIG. 1.

A modification of the abovementioned embodiment will be described referring to FIG. 3. Difference in construction between this modification and the embodiment in FIG. 1 is that the auxiliary fuel ports 22 are omitted, and the auxiliary fuel passage 23 is fluidly connected to the EGR passage 17 through a passage 32 so that fuel from the float chamber 6 is jetted from the vacuum intake ports 18. As the other construction of the modification is the same as that in FIG. 1, its explanation is omitted. The operation of the modification is the same as that of the embodiment in FIG. 1, except for that fuel in the float chamber 6 is sucked into the suction passage 2 from the vacuum intake ports 18 through the fuel passage 23, the passage 32 and the vacuum passage 17.

Another embodiment of the present invention will be described hereinafter in detail, referring to FIG. 4, except for the same construction as that of the embodiment in FIG. 1.

Figure 4:
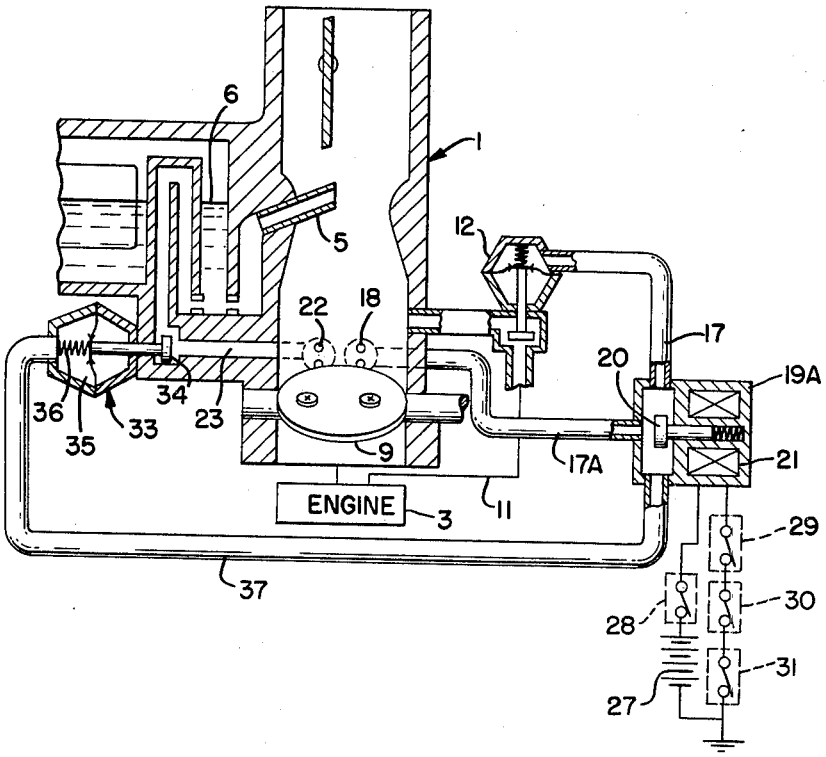
FIG. 4 is another embodiment of the carburetor with the fuel compensation device according to the present invention.

In FIG. 4, a diaphragm valve 33 is used in place of the solenoid valve 24 in FIG. 1. The diaphragm valve 23 is provided with a valve body 34 for closing or opening the auxiliary fuel passage 23, a diaphragm securing the valve body 34, a vacuum chamber 35, and a spring 36 disposed in the vacuum chamber 35 and urging the valve body 34 to close the auxiliary fuel passage 23. The vacuum chamber 35 communicates with a three way solenoid valve 19A used in place of the solenoid valve in FIG. 1 through a vacuum passage 37. The three way solenoid valve 18A controls opening and closing of the vacuum passage 17A by the valve body electrically driven by the solenoid. The diaphragm valve 33 and the EGR valve 12 are constructed such that the same vacuum from the vacuum intake valve 18 is applied to both the valves 33 and 12 and they are controlled to open or close the auxiliary fuel passage 23 and the EGR passage 1Q at the same time.

When all of the switches 28, 29, 30 and 31 is closed whereby the three way solenoid valve 19A and the diaphragm 33 are opened, and vacuum at the vacuum intake ports 18 is larger than a predetermined value, they are opened at the same time thereby effecting the recirculation of an exhaust gas and jetting of fuel from the auxiliary fuel ports, corresponding to rate of a quantity of exhaust gas recirculating to a quantity of sucked fuel-air mixture. Therefore, the fuel-air mixture is compensated appropriately.

According to the present invention, fuel compensation corresponding to the rate of the recirculation of exhaust gas can be effected so that a fuel-air ratio can be kept suitably. Accordingly, reduction of large fuel consumption and $NO_x$ reduction and protection of the catalyst can be carried out, without debasement of the operation performance of the engine.

Figure 5:
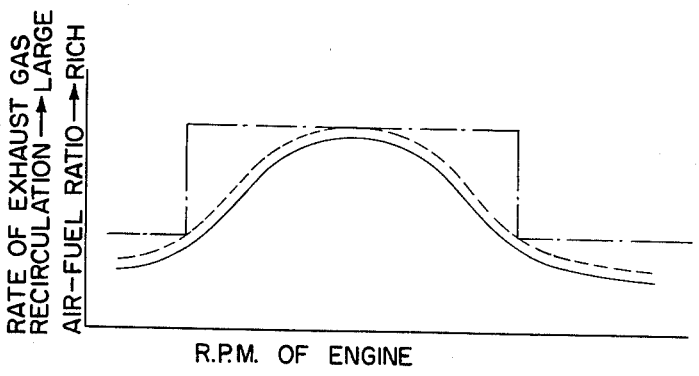
FIG. 5 is a graph showing various characteristics.

As compared with a carburetor with a conventional fuel compensation device, referring to FIG. 5 in which a characteristic curve A shows a relation between r.p.m. of the engine 3 and the rate of exhaust gas recirculation, a characteristic curve B shows a fuel-air ratio during the exhaust gas recirculation by the carburetor with the fuel compensation device according to the present invention, and a dot and dash line C shows a relation between r.p.m. of an engine and, a carburetor provided with the conventional fuel compensation device, it is noted that the fuel-air ratio according to the present invention corresponds more to the rate of the exhaust gas recirculation than that according to the conventional device.

What is claimed is:

1. A carburetor with a fuel compensation device for an internal combustion engine comprising a suction passage having a Venturi, a main fuel nozzle fluidly communicating with a float chamber for jetting fuel from the float chamber into the suction chamber, and throttle valve disposed downstream of the main fuel nozzle with respect to a fluid flow flowing in the suction passage, exhaust gas recirculation means for recirculating an exhaust gas from the engine through the exhaust gas recirculation means, the suction passage, and the engine, means responsive to vacuum at a position of the suction slightly upstream of a position of the throttle valve at which idling of the engine is effected, for controlling an exhaust gas flow flowing from the engine into the suction passage corresponding to the vacuum, auxiliary fuel jet means for jetting fuel from the float chamber into the suction passage in response to the same vacuum as the vacuum to which the means for controlling the exhaust gas flow is responsive, and valve means for controlling both the means for controlling the exhaust gas flow and the auxiliary fuel jet means.

2. The carburetor as defined in claim 1, wherein the means for controlling the exhaust gas flow comprises an exhaust gas recirculation valve, a vacuum intake port defined in the suction passage at the position slightly upstream of the position of the throttle valve which the engine is idling, and passage means for communication between the exhaust gas recirculation valve and the vacuum intake port, so that the exhaust gas is controlled by the exhaust gas recirculation valve in response to the vacuum at the vacuum intake port.

3. The carburetor as defined in claim 2, wherein the auxiliary fuel jet means comprises an auxiliary fuel jet port defined in the suction passage at the position slightly upstream of the position of the throttle valve at which the engine is idling, and passage means for communication between the auxiliary fuel jet port and the float chamber 4. The carburetor as defined in claim 2, wherein the auxiliary fuel jet means comprises the vacuum intake port and passage means for fluidly connecting the vacuum intake port with the float chamber.

5. A carburetor with a fuel compensation device for an internal combustion engine comprising a suction passage having a Venturi, a main fuel nozzle fluidly communicating with a float chamber for jetting fuel from the float chamber into the suction chamber, and a throttle valve disposed downstream of the main fuel nozzle with respect to a fluid flow flowing in the suction passage, an exhaust gas recirculation passage for introducing an exhaust gas from the engine into the suction passage, first valve means responsive to vacuum, for controlling a quantity of the exhaust gas in the exhaust gas recirculation passage corresponding to the vacuum, a vacuum package by which the first valve means fluidly communicates with a vacuum intake port of the suction passage, the vacuum intake port being disposed slightly downstream of a position of the throttle valve at which idling of the engine can be kept, second valve means for controlling an opening of the vacuum passage, an auxiliary fuel passage by which the float chamber fluidly communicates with an auxiliary fuel jet port disposed at the same position as the vacuum intake port, and third valve means for controlling an opening of the auxiliary fuel passage, 6. The carburetor as defined in claim 5, wherein the third valve means comprises a valve body, and a solenoid for electrically driving the valve body.

7. The carburetor as defined in claim 5, wherein the third valve means comprises a valve body, a diaphragm securing the valve body thereto, a vacuum chamber part of which is defined by the diaphragm so that the vacuum chamber is expansible in response to vacuum, and a vacuum passage by which the vacuum chamber communicate with the second valve so that the third valve means and the first valve means are controlled at the same time.

* * * * *